US006497171B2

(12) United States Patent
Gerber et al.

(10) Patent No.: US 6,497,171 B2
(45) Date of Patent: Dec. 24, 2002

(54) METHOD FOR CORRECTING DYNAMIC GUN ERRORS

(75) Inventors: Michael Gerber, Zürich (CH); Gabriel Schneider, Zürich (CH)

(73) Assignee: Oerlikon Contraves AG, Zurich (CH)

( * ) Notice: Subject to any disclaimer, the term of this patent is extended or adjusted under 35 U.S.C. 154(b) by 0 days.

(21) Appl. No.: 09/768,423

(22) Filed: Jan. 24, 2001

(65) Prior Publication Data

US 2001/0039874 A1 Nov. 15, 2001

(30) Foreign Application Priority Data

May 11, 2000 (CH) ..... 0918/00

(51) Int. Cl.[7] ..... F41G 5/16
(52) U.S. Cl. ..... 89/41.09; 89/41.02
(58) Field of Search ..... 89/41.09, 41.01, 89/41.02

(56) References Cited

U.S. PATENT DOCUMENTS 4,480,524 A 11/1984 Blomqvist et al.
4,570,530 A * 2/1986 Armstrong ..... 89/41.09
4,606,256 A * 8/1986 De'Ath ..... 89/41.09
4,885,977 A * 12/1989 Kirson et al. ..... 89/41.05
5,012,081 A * 4/1991 Jungwirth et al. ..... 250/203.6
5,520,085 A 5/1996 Ng et al.
5,631,437 A 5/1997 LaVigna et al.
5,897,223 A * 4/1999 Tritchew et al. ..... 396/13
5,949,015 A * 9/1999 Smith et al. ..... 89/41.05

FOREIGN PATENT DOCUMENTS

EP 0 878 686 A2 11/1998
FR 1564597 * 4/1980 ..... 89/41.09

* cited by examiner

*Primary Examiner*—Stephen M. Johnson
(74) *Attorney, Agent, or Firm*—McCormick, Paulding & Huber LLP

(57) ABSTRACT

The invention relates to a method and a device for the correction of dynamic gun errors. Dynamic gun errors are caused by the movement of a gun tube muzzle area (3) of a gun (1) in the course of continuous firing. To correct these errors, a measurement of the movement of a gun tube muzzle area (3) of a gun (1) is performed during continuous firing for obtaining measured signals. The measured signals are used for correcting the azimuth and elevation of the gun tube (2) in order to compensate the movement of a gun tube muzzle area (3).

2 Claims, 2 Drawing Sheets

METHOD FOR CORRECTING DYNAMIC GUN ERRORS

FIELD OF THE INVENTION

The invention relates to a method for the correction of dynamic gun errors caused by the movement of the gun tube muzzle area of a gun tube of a gun aimed in regard to elevation and azimuth during continuous firing. The invention also relates to a device for executing the method.

BACKGROUND OF THE INVENTION

The gun structure and the gun tube of guns, in particular those with a high rate of fire, are highly stressed dynamically in the course of continuous firing. Although, prior to the start of continuous firing, the gun tube is aimed on a target, or on a location where the projectiles to be fired meet the target, inter alia an uncontrolled spatial movement of the muzzle area of the gun tube results from the forces acting during continuous firing, which cause departure errors of the round and a reduction in the probability of a hit. Within the framework of the present specification, such errors are called dynamic gun errors or directional muzzle errors.

No useful solution of this problem has been known up to now.

OBJECT AND SUMMARY OF THE INVENTION

The object of the invention is seen to lie in proposing a precise and efficient method, which can be performed with an economically advantageous device, and which can also be used in the field, by means of which the mentioned errors can be prevented, or at least greatly reduced, and wherein an increased probability of hits is achieved.

In accordance with the invention, a measurement of the movement of the muzzle area of the gun tube, the gun tube muzzle area for short, takes place in the course of continuous firing. The measured signals obtained in the course of this are evaluated for performing a correction of the original direction of the gun tube, or to change the position of the gun tube, i.e. its elevation and its azimuth, in such a way that the movement of the gun tube muzzle area is compensated. It is possible in this way to prevent departure errors of the round.

For this purpose, an angular measuring device is arranged in the gun tube muzzle area, which has two measuring sensors, which are arranged, offset by 90° in respect to each other, in a plane transversely in respect to the longitudinal axis of the gun tube.

Dynamic gun errors, or dynamic directional muzzle errors, are actively compensated by means of the invention, so that a reduced deviation and therefore an increased hit probability is achieved.

In connection with a special embodiment of the invention in particular, the angular measuring device is constituted by two measuring sensors, each of which has a fiber-optical gyro. Shortly before the beginning of continuous firing, the fiber-optical gyro angles are aligned with the coding device angles of the gun. The measurement of the movement of the gun tube muzzle area takes place during continuous firing in that the deviations of the measured fiber-optical gyro angles from the coding device angles are continuously determined. The deviations in the direction of the gun tube muzzle from the originally determined and set reference direction are thus measured. The measured signals obtained in this way are used to regulate the drive mechanisms provided for aiming the gun tube.

The following should be mentioned as particularly advantageous for attaining the object with the aid of fiber-optical gyros:

- the measuring principle is advantageous, because the actual spatial angle errors of the gun tube muzzle area are determined by the measurement,
- the measurement is independent of external influences,
- the measuring sensors used are comparatively cost-effective and sturdy, they have no moving parts, do not get dirty and are not subjected to any exterior influences,
- balancing or alignment processes, which must be performed prior to the actual measurement, can be executed without problems,
- the intended correction of the dynamic gun errors, or muzzle direction errors, can take place continuously from one shot to the next.

The invention will be explained in what follows by means of an exemplary embodiment, making reference to the drawings.

DETAILED DESCRIPTION OF THE PREFERRED EMBODIMENT

Figure 1:
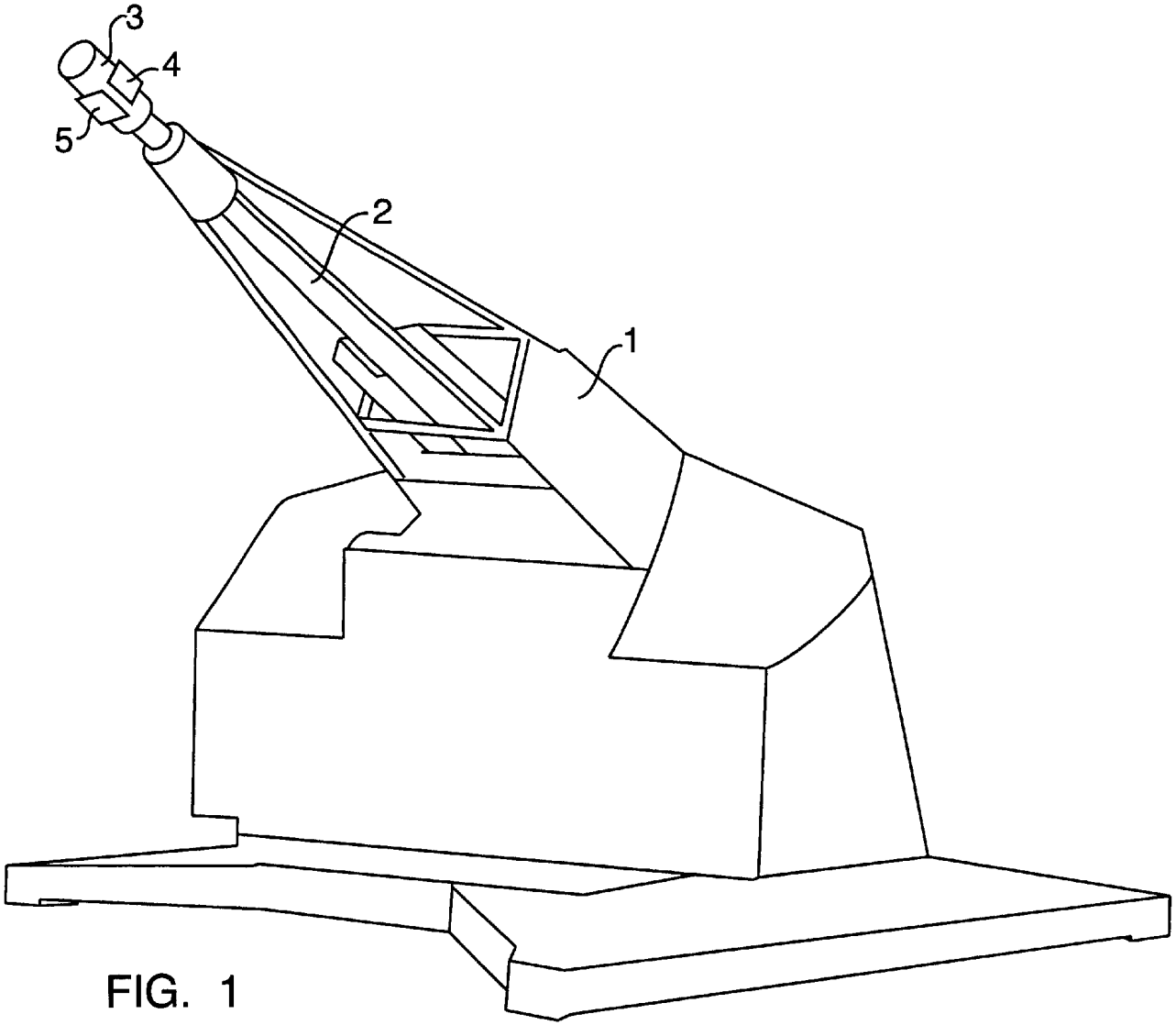
FIG. 1 is a simplified perspective representation of a gun with a part of the device in accordance with the invention.

A gun 1, which is particularly suitable for rapid continuous firing, is represented in FIG. 1. A measuring device, comprising a first measuring sensor 4 and a second measuring sensor 5, which are offset by 90° in respect to each other in a plane perpendicularly to the longitudinal axis of the gun tube 2 of the gun 1, is arranged in the area of the gun tube muzzle 3 of a gun tube 2 of the gun 1. An offset of 90° is particularly advantageous, however, offsets by smaller angles than 90 are also possible. Moreover, although it is particularly advantageous not to offset the measuring sensors 4, 5 in respect to each other in the direction of the longitudinal axis of the gun tube 2, this is not absolutely necessary.

The first measuring sensor 4 is assigned to a drive mechanism for pivoting the gun tube 2 for setting the elevation, and the second measuring sensor 5 is assigned to a drive mechanism for pivoting the gun tube 2 for setting the azimuth. These are drive mechanisms which are provided on such guns anyway for aiming the gun tube in respect to the elevation $\lambda$ and the azimuth $\alpha$, and which are therefore not represented in greater detail, nor explained.

The purpose of the measuring sensors 4 and 5 is to detect the movement of the gun tube 2 during continuous firing and to convert it into electrical measured signals, or output signals. Each one of the measuring sensors 4, 5 has a fiber-optical gyro, which operates in accordance with the principle of gyro measuring.

A fiber-optical gyro essentially consists of a ring interferometer, in which beams generated by a laser rotate in opposite directions and interfere with each other, wherein the ring for the beam path is formed by a number of windings of a fiberglass arrangement, into which the beam generated by the laser is coupled. If such a ring interferometer is arranged at right angles in respect to the plane of the beam path, a difference in the path of the oppositely rotating beams generated by the laser occurs, which is known from a Sagnac test, and therefore a displacement of the interference strips generated by them, or a change in the interference pattern. These changes in the interference pattern are sensed by a detector and are transmitted as output signals in the form of rates of rotation, or angle changes. In other embodiments of fiber-optical gyros, the Doppler effect which occurs between the oppositely rotating beams, is used for determining the angular changes.

The measuring device is connected with a regulating device. In accordance with FIG. 2, the measuring sensor 4 is connected with a first input e1 of a first regulating unit 10. On its output side, the regulating unit 10 is connected via lines R, S, T with a motor 11 of the one drive mechanism, namely that for pivoting the gun tube 2 in the vertical direction, or for setting the elevation. The motor 11 is directly connected with a synchro resolver 12, then further via a planetary gear 13 with a load 14, which corresponds to the part of the gun 1 to be moved, and still further via a measuring gear 15 with an encoder 16. The synchro resolver 12 is connected to a second input e2 of the regulating unit 10, and the encoder 16 is connected to a third input e3 of the regulating unit 10. A reference velocity, or a reference position, are supplied via a fourth input e4 and a fifth input e5 to the regulating unit 10.

During firing operations, the rates of rotation of the measuring sensor 4, information regarding the actual position of a cradle, or carriage, of the gun 1, generated by the encoder 16, the reference velocity, as well as reference position, are processed in the regulating unit 10 in such a way, that it is possible to change the number of revolutions of the motor 11 in accordance with the information entered via the lines R, S, T, and in this way to affect the position of the gun tube 2, and thus to compensate the movement of the gun tube muzzle 2.

Figure 2:
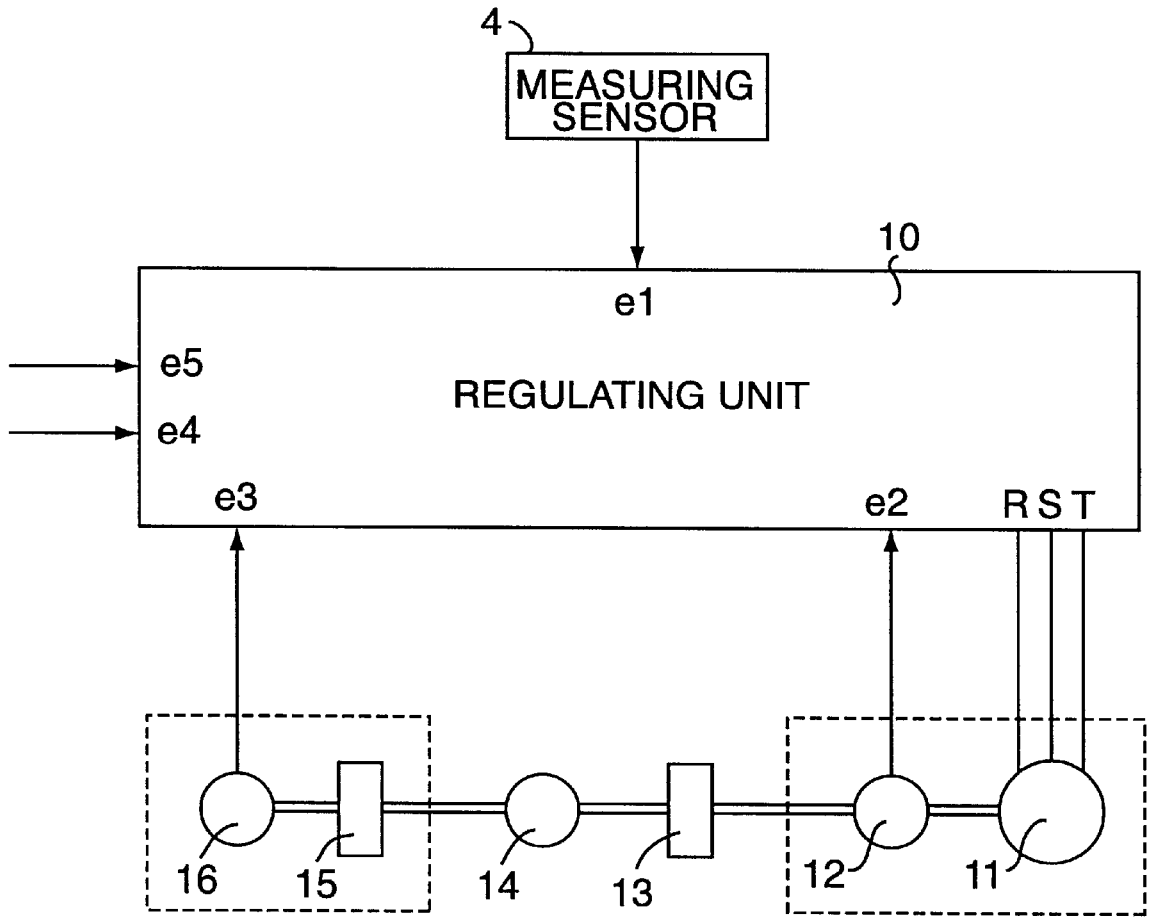
FIG. 2 is a simplified representation of a block diagram of the device of the invention.

The further drive mechanism provided for the pivoting of the gun tube 2 for setting the azimuth is controlled by means of a further regulating device, not represented, which is similar to the regulating unit 10 described in connection with FIG. 2.

Shortly before triggering the continuous firing of the gun 1, the fiber-optical gyros of the measuring members 4 and 5 are matched to the coding device angles of the gun 1. During continuous firing, the deviations of the fiber-optical gyro angles from the coding device angles are evaluated in the regulating unit 10 and are used for regulating the drive mechanisms for pivoting the gun tube 2.

What is claimed is:

1. A method for the correction of dynamic gun errors caused by movements of the gun tube muzzle area of a gun tube of a gun, aimed by means of drive mechanisms in regard to elevation ($\lambda$) and azimuth ($\alpha$), during continuous firing, including the steps of:

measuring the movement of the gun tube muzzle area during continuous firing for obtaining measured signals, wherein the measurement of the movement of the gun tube muzzle area is performed with the aid of two measuring sensors, which measure angles and each has a fiber-optical gyro, feeding the measured signals of the two measuring sensors to a regulating device, processing the measured signals in the regulating device to generate steering signals for the drive mechanisms, and correcting the elevation ($\lambda$) and the azimuth ($\alpha$) of the gun tube by the drive mechanisms in response to the steering signals generated from the measured and processed signals in order to compensate the movement of the gun tube muzzle area.

2. The method in accordance with claim 1, comprising the steps of:

matching of the fiber-optical gyro angles of the fiber-optical gyros and of the coding device angles of the gun shortly before triggering the continuous firing, the step of measuring during continuous firing including a continuous measurement by means of the fiber-optical angles, and evaluating the measured signals, which correspond to deviations of the fiber-optical gyro angles from the coding device angles for regulating drive mechanisms, which are used for setting the elevation ($\lambda$) and the azimuth ($\alpha$) of the gun tube.

* * * * *